US010159119B2

(12) United States Patent
Lee et al.

(10) Patent No.: US 10,159,119 B2
(45) Date of Patent: Dec. 18, 2018

(54) COOKING DEVICE

(71) Applicant: LG ELECTRONICS INC., Seoul (KR)

(72) Inventors: Youngjun Lee, Seoul (KR); Yangkyeong Kim, Seoul (KR); Seungjo Baek, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 241 days.

(21) Appl. No.: 15/025,476

(22) PCT Filed: Sep. 29, 2014

(86) PCT No.: PCT/KR2014/009138
§ 371 (c)(1),
(2) Date: Mar. 28, 2016

(87) PCT Pub. No.: WO2015/047006
PCT Pub. Date: Apr. 2, 2015

(65) Prior Publication Data

US 2016/0242240 A1 Aug. 18, 2016

(30) Foreign Application Priority Data

Sep. 27, 2013 (KR) ..... 10-2013-0114905

(51) Int. Cl.

| | |
|---|---|
| ***H05B 6/64*** | (2006.01) |
| ***F24C 7/04*** | (2006.01) |
| ***H05B 1/02*** | (2006.01) |
| ***H05B 6/76*** | (2006.01) |

(52) U.S. Cl.
CPC ..... *H05B 6/6482* (2013.01); *F24C 7/04* (2013.01); *H05B 1/0263* (2013.01); *H05B 6/76* (2013.01)

(58) Field of Classification Search
CPC ..... H05B 6/6482; H05B 1/0263; H05B 6/76
USPC ..... 219/521, 685, 702, 709, 713, 741
See application file for complete search history.

(56) References Cited

U.S. PATENT DOCUMENTS

| | | | | |
|---|---|---|---|---|
| 3,738,219 A | | 6/1973 | Febres | |
| 3,783,219 A | * | 1/1974 | Tateda | H05B 6/642 126/198 |
| 3,878,350 A | * | 4/1975 | Takagi | F24C 7/02 219/685 |
| 4,358,653 A | * | 11/1982 | Weiss | F24C 15/021 219/685 |
| 2003/0024925 A1 | | 2/2003 | Graves et al. | |

FOREIGN PATENT DOCUMENTS

| | | | |
|---|---|---|---|
| CN | 2725750 Y | | 9/2005 |
| CN | 102487554 | * | 6/2012 |
| CN | 102487554 A | | 6/2012 |

(Continued)

*Primary Examiner* — Thien S Tran
(74) *Attorney, Agent, or Firm* — Dentons US LLP

(57) ABSTRACT

A cooking device according to one embodiment of the present invention includes a cooking chamber configured to provide a space in which food is cooked; a magnetron configured to emit microwaves to the cooking chamber; and a heater configured to emit radiant heat to the cooking chamber, wherein the heater includes a filament, an outer pipe which protects the filament, and a blocking member which is located at an outside of the filament to block the microwaves emitted from the magnetron.

12 Claims, 6 Drawing Sheets

(56) References Cited

FOREIGN PATENT DOCUMENTS

| | | | | |
|---|---|---|---|---|
| CN | 103052178 | A | | 4/2013 |
| EP | 0053189 | | * | 6/1981 |
| EP | 0 053 189 | A1 | | 6/1982 |
| EP | 0 226 343 | A2 | | 6/1987 |
| EP | 0 251 539 | A1 | | 1/1988 |
| EP | 0 977 468 | A2 | | 2/2000 |
| EP | 1 005 255 | A1 | | 5/2000 |
| GB | 2 353 897 | A | | 3/2001 |
| JP | 9-280569 | A | | 10/1997 |
| JP | 05080647 | B2 | | 11/2012 |
| KR | 10-2002-0006910 | A | | 1/2002 |
| KR | 10-2004-0035494 | A | | 4/2004 |
| KR | 20-0399008 | Y1 | | 10/2005 |
| KR | 10-2009-0074868 | A | | 7/2009 |
| WO | 98/34436 | A1 | | 8/1998 |
| WO | 02/085073 | A1 | | 10/2002 |
| WO | 2009/091145 | A2 | | 7/2009 |

* cited by examiner

COOKING DEVICE

This application is a National Stage entry of International Application No. PCT/KR2014/009138, filed on Sep. 29, 2014, and claims priority to Korean Application Nos. 10-2013-0114905 filed Sep. 27, 2013, both of which are hereby incorporated by reference in their entireties as if fully set forth herein.

TECHNICAL FIELD

The present invention relates to a cooking device.

BACKGROUND ART

A cooking device is one of kitchen utensils which heat and cook food to an edible state. The cooking device may be classified into an electric cooking device and a gas cooking device depending on a type of a heating source.

A heater which receives electric power and generates heat may be installed at the electric cooking device, and a burner which burns a supplied gas and generates the heat by a flame may be installed at the gas cooking device.

Also, according to a type thereof, the cooking device may be classified into an oven type which heats the food in a state in which the food is accommodated in a cooking chamber providing a space for cooking the food, and a range type which heats a cooking container, in which the food is accommodated, at an open space.

Recently, a multipurpose type cooking device which satisfies users' tastes while enabling a variety of foods to be cooked, i.e., an oven range type cooking device in which the oven type and the range type are combined is provided.

And various types of heating sources for heating the food may be installed at the cooking device. A magnetron which applies microwaves to the accommodated food and heats the food, a heater which converts electric energy of the supplied electric power into heat energy and heats the accommodated food, or a burner which generates the heat by the flame generated by burning the supplied gas may be installed as the heating source.

Recently, a cooking device in which two or more heating sources are installed to cook the variety of foods is provided, and another cooking device type in which the magnetron and the heater are installed or the heater and the burner are installed may be provided.

Meanwhile, in Korean Patent Publication No. 2007-0038653 (hereinafter, referred to as a "first prior art document"), there is disclosed an invention related to a heater which may be optimally used in a cooking device. In the first prior art document, there is disclosed a carbon heater including a carbon filament which has a predetermined thermal expansion coefficient and generates heat by applying the electric power thereto; a heat generating member which has a thermal expansion coefficient different from that of the carbon filament and is mutually supported by the carbon filament; and a tube which is spaced apart from the carbon filament and the heat generating member while the carbon filament and the heat generating member are sealingly inserted therein.

Also, in Korean U.M. Registration No. 20-0399008 (hereinafter, referred to as a "second prior art document"), there is disclosed an invention related to an electric oven using a carbon heater, which is manufactured using the carbon heater formed of a porous basalt fiber to remarkably enhance a heat generating area, and thus capable of being manufactured to have a large capacity while generating high temperature heat and also to be beneficial to a human body.

The second prior art document describes a configuration of the electric oven using the carbon heater, which includes a heater stand which is manufactured in a quadrangular frame shape, a plurality of carbon heaters which are installed at a frame of the heater stand at regular intervals, and a fire resisting wall which is installed to cover an outside of the heater stand and the carbon heater and thus to insulate internal heat.

As described in the first and second prior art documents, recently, a technique which increases radiant heat through various kinds of heaters and various types of structures, and thus reduces a cooking time of the food has been continuously developed.

And a technique which enables a variety of foods to be cooked by installing a plurality of heating sources to cook the variety of foods and heating the foods has been also continuously developed.

Since the plurality of heating sources are installed, a cooking operation is performed by heating the foods according to a property of each of the heating sources, and a cooking chamber should be formed to be appropriate to the property of each of the heating sources.

Like this, it may be confirmed that the heating source is an important factor in cooking the food, and a configuration which enhances a calorific value of the radiant heat or the like is important for reducing the cooking time of the food.

DISCLOSURE

Technical Problem

The present invention is directed to providing a cooking device in which a magnetron generating microwaves and a heater generating radiant heat are simultaneously installed to enable a variety of foods to be cooked, and emission performance of the radiant heat is enhanced.

Also, the present invention is directed to providing a cooking device in which a heater having a blocking member for blocking the microwaves applied to the heater generating the radiant heat is installed.

Technical Solution

One aspect of the present invention provides a cooking device including a cooking chamber configured to provide a space in which food is cooked; a magnetron configured to emit microwaves to the cooking chamber; and a heater configured to emit radiant heat to the cooking chamber, wherein the heater includes a filament, an outer pipe which protects the filament, and a blocking member which is located at an outside of the filament to block the microwaves emitted from the magnetron.

Another aspect of the present invention provides a cooking device including a cooking chamber configured to provide a space in which food is cooked; a magnetron configured to emit microwaves to the cooking chamber; and a heater configured to emit radiant heat to the cooking chamber, wherein the heater includes a blocking member which blocks the microwaves emitted from the magnetron, an outer pipe which is located inside the blocking member, and a filament which is located inside the outer pipe.

Still another aspect of the present invention provides a cooking device including a plate configured to form a cooking chamber and having an opening; a carbon heater installed at the plate; and a magnetron installed at the plate, wherein the carbon heater includes a blocking member which prevents microwaves emitted from the magnetron from being radiated to a filament disposed therein, and allows heat and light generated from the filament to pass therethrough.

Advantageous Effects

According to the present invention, since the blocking member which blocks the microwaves is removed from the cooking chamber, and the heater has the blocking member, the radiant heat of the carbon heater emitted to the cooking chamber can be maximized, and a cooking time of the food can be reduced by maximization of the radiant heat.

Also, since the cooking time of the food is reduced, energy using efficiency can be enhanced, and a user's time utilization can be enhanced.

And due to such a configuration, a manufacturing cost of the cooking device can be reduced, and a manufacturing time is also reduced, and productivity can be enhanced, and thus price competitiveness can be enhanced.

MODES OF THE INVENTION

Hereinafter, a cooking device according to exemplary embodiments will be described in detail with reference to the accompanying drawings.

However, the present invention is not limited to the exemplary embodiments disclosed below, and the terms used in the following description are concepts selected for convenience of explanation, and should be appropriately interpreted based on the meanings corresponding to technical aspects of the present invention in grasping the technical contents.

And the terms are used for distinguishing one component from other components, and thus the substance or the order of the components should not be limited by the terms.

Figure 1:
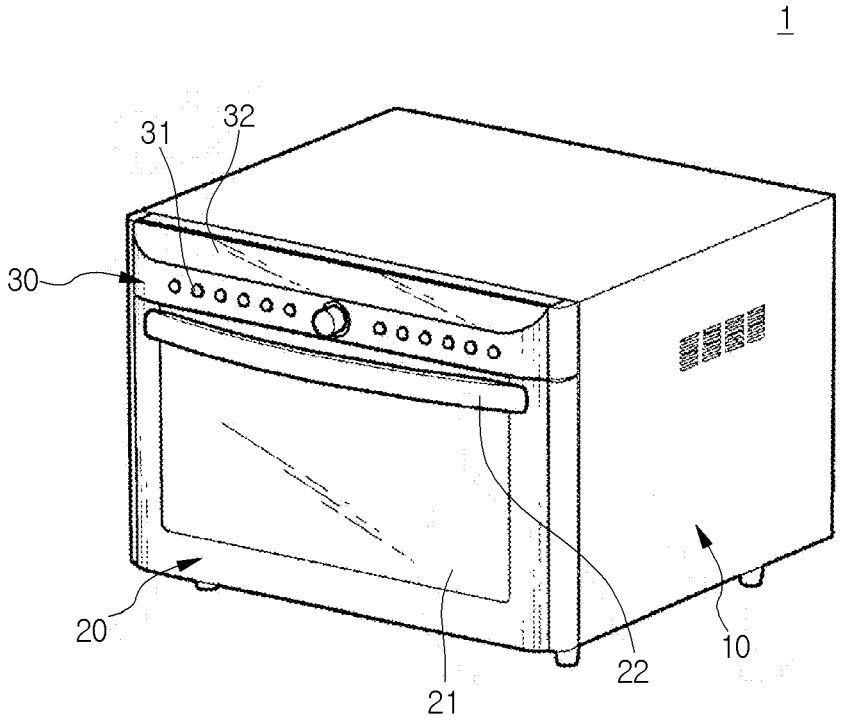
FIG. 1 is a perspective view illustrating an external appearance of a cooking device according to an embodiment.
Figure 2:
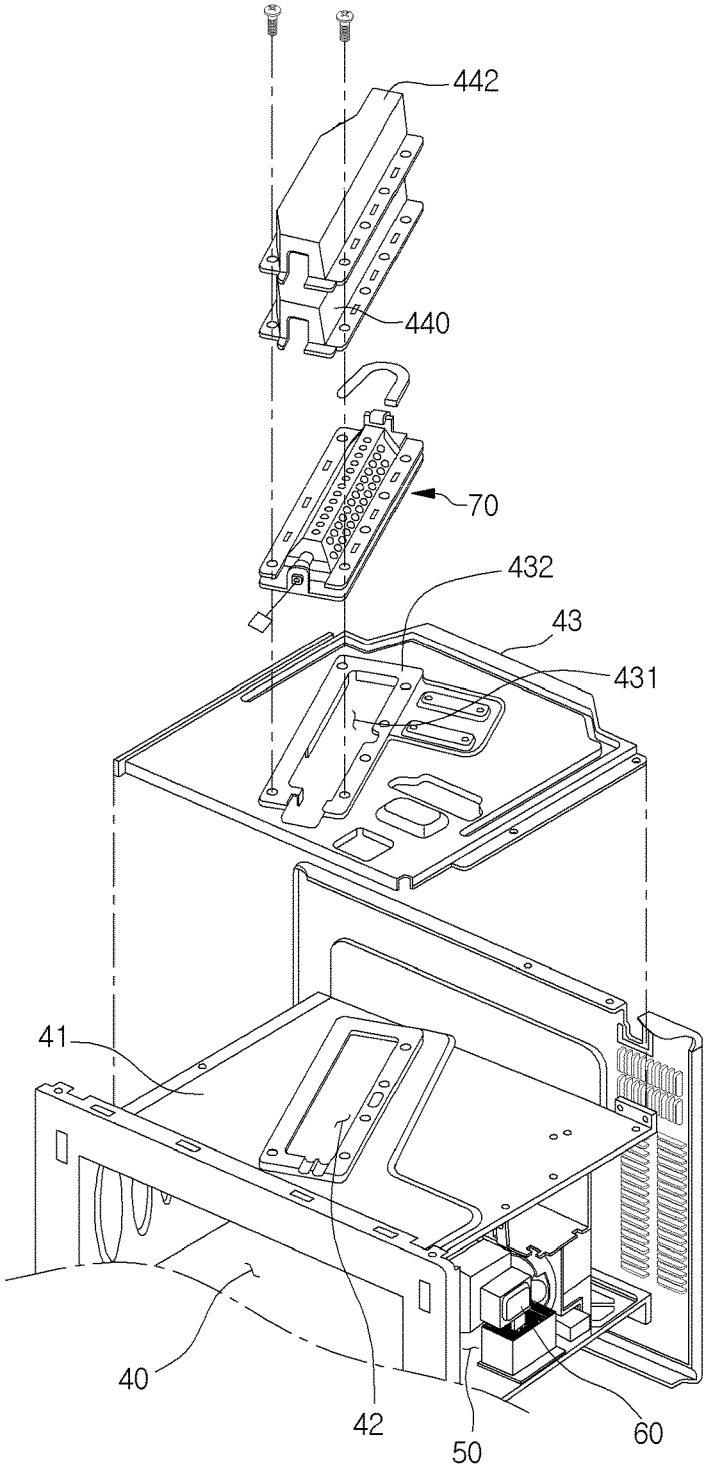
FIG. 2 is a partially exploded perspective view of the cooking device according to the embodiment.

FIG. 1 is a perspective view illustrating an external appearance of a cooking device according to an embodiment, and FIG. 2 is a partially exploded perspective view of the cooking device according to the embodiment.

Referring to FIGS. 1 and 2, a cooking device 1 according to the embodiment may be generally formed in a rectangular parallelepiped box shape having a predetermined-sized internal space.

Of course, the cooking device 1 may be formed in a spheral shape. A rectangular parallelepiped external appearance is widely used to enable a variety of and complex foods to be cooked.

The cooking device 1 may include a case 10 which forms the external appearance, a door 20 which selectively opens and closes a front surface of the case 10, and a display part 30 which is formed at one side of the door 20 to directly control an operation of the cooking device 1 or to notify an operating state thereof to a user.

The case 10 may form an internal space by coupling a plurality of plates having a predetermined thickness, and may protect a plurality of components installed at the internal space from an external shock.

Specifically, the plate may include a lower plate which forms the external appearance of a lower surface while supporting the plurality of components, a front plate and a rear plate of which lower ends are coupled to the lower plate and which form the external appearance of a front surface and a rear surface, and an external plate which forms the external appearance of an upper surface and both side surfaces and of which a lower end is coupled to the lower plate.

Also, the door 20 may be in a quadrangular plate shape having a predetermined thickness, and may have a see-through window 21 which is formed at a center portion thereof to enable the user to check a cooking state of the food from an external space.

A door handle 22 which is gripped by the user may be installed at an upper side of a front surface of the door 20, and a front surface of the case 10 may be selectively opened and closed by gripping the door handle 22 and operating the door 20.

The display part 30 is located above the door 20 which forms a part of a front surface of the cooking device 1. The display part 30 may include a plurality of buttons 31 which are directly operated by the user to cook the food, and a display window 32 which notifies the operating state of the cooking device to the user.

A cooking chamber 40 which provides a space for cooking the food may be formed at the internal space of the case 10 which is selectively opened and closed by rotation of the door 20 to have a predetermined internal space, and an electronic component chamber 50 in which a plurality of electronic components are installed may be disposed at one side of an outside of the cooking chamber 40.

The electronic component chamber 50 may be disposed at a space formed at a rear of a portion at which the display part 30 is located, and may be located at one lateral side of the cooking chamber 40. That is, the electronic component chamber 50 may be disposed at an upper side or a lateral side of the cooking chamber 40, or may be disposed at each of the upper side and the lateral side.

A magnetron 60 which emits microwaves to the internal space of the cooking chamber 40, and a heater 70 which emits radiant heat to the internal space of the cooking chamber 40 may be disposed at the electronic component chamber 50. Of course, while a plurality of other electronic components may be installed together, the food located at the internal space of the cooking chamber 40 may be cooked.

A predetermined opening 42 may be formed at one surface of the cooking chamber 40, specifically, a surface thereof at which the heater 70 is installed, such that the radiant heat emitted from the heater 70 is emitted to the internal space of the cooking chamber 40.

The embodiment of the present invention will describe an example of a configuration in which the heater 70 is installed at the upper side of the cooking chamber 40.

The opening 42 providing a path through which light or the radiant heat emitted from the heater 70 is transmitted to the cooking chamber 40 is formed at an upper plate 41 which forms an upper surface of the cooking chamber 40.

An insulator 43 is installed at an upper side of the upper plate 41. The insulator 43 is formed in a plate shape having a predetermined thickness, and prevents heat emitted from the heater 70 from being transferred to other portions except the cooking chamber 40.

A through part 431 is formed at the insulator 43. The through part 431 may provide a path through which the radiant heat emitted from the heater 70 is transmitted to the cooking chamber 40.

That is, the light and/or the heat emitted from the heater 70 may pass through the through part 431 and the opening 42, and may be emitted to the internal space of the cooking chamber 40.

Accordingly, the through part 431 and the opening 42 may be disposed at positions corresponding to each other, and may be formed in shapes corresponding to each other. In the embodiment of the present invention, the through part 431 and the opening 42 are formed in rectangular shapes. However, the shapes of the through part 431 and the opening 42 are not limited according to a shape of the heater 70.

A heater supporter 432 which supports the heater 70 may be installed at a boundary portion of the through part 431. In a state in which the heater 70 is supported by the heater supporter 432, a reflecting plate 440 which reflects the heat and/or the light emitted from the heater 70 to the internal space of the cooking chamber 40 may be installed at an upper side of the heater 70.

The reflecting plate 440 may be located to be spaced apart from the heater 70 at a predetermined distance, and may be installed to cover the upper side and both lateral sides of the heater 70. A reflecting plate cover 442 may be installed at an outside of the reflecting plate 440 to cover the outside while being spaced apart from the reflecting plate 440 at a predetermined distance, and a plurality of through-holes through which air flows so as to cool the heater 70 may be formed at the reflecting plate cover 442.

A heater cover (not shown) which shields an outside of the reflecting plate cover 442 may be installed at the outside of the reflecting plate cover 442. The reflecting plate cover 442 and the heater 70 may be protected from an external shock by the heater cover.

Figure 3:
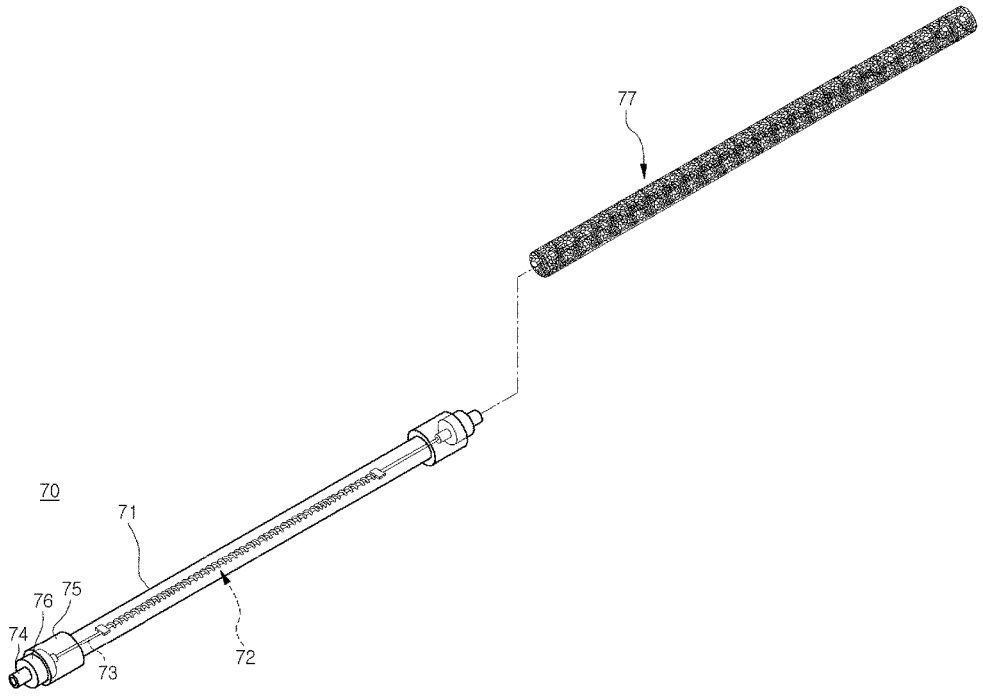
FIG. 3 is a perspective view illustrating a heater of the cooking device according to the embodiment.
Figure 4:
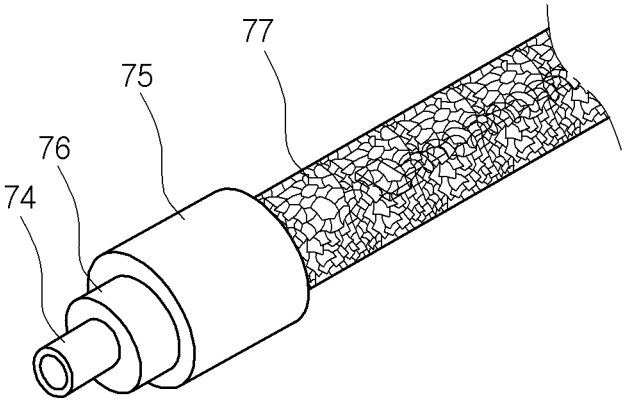
FIG. 4 is an enlarged perspective view illustrating a part of the heater of the cooking device according to the embodiment.

FIG. 3 is a perspective view illustrating the heater of the cooking device according to the embodiment, and FIG. 4 is an enlarged perspective view illustrating a part of the heater of the cooking device according to the embodiment.

Referring to FIGS. 3 and 4, the heater 70 according to the embodiment may include a carbon heater in which a filament for emitting the heat by supplied electric power is formed of carbon fiber.

In the carbon heater, the filament which emits the heat may be formed of the carbon fiber having a certain crystal structure.

The heater 70 may include an outer pipe 71 which has a predetermined internal space. The outer pipe 71 may be formed to have a tube shape which is long in one direction, and the internal space may be filled with an inert gas such as argon gas, and may be maintained in a low vacuum state.

A quartz pipe of which an inside is sealed may be used as the outer pipe 71, and a filament 72 which is woven with the carbon fiber having a certain specification to have a certain function and forms a heat wire may be located at the internal space of the outer pipe 71. The filament 72 is heated by supplied electric energy, and emits the radiant heat.

Like this, in the heater 70, the carbon fiber having the certain crystal structure is woven into the filament 72, and located and sealed at the internal space of the outer pipe 71, and then the filament 72 is graphitized. Therefore, the heater 70 has an excellent advantage such as resistance stability when the heat is generated.

The filament 72 woven with the carbon fiber has excellent rising and descending temperature characteristics and excellent high temperature durability. Also, since the filament 72 is manufactured by weaving a plurality of carbon fiber bundles, the filament 72 may have high flexibility, and may be easily machined in various structures and shapes.

The embodiment has described an example of the filament 72 which is woven and formed in a spiral structure. However, the filament 72 may be provided in various types and kinds such as a sheet type filament, a straight type filament and a sponge type filament.

Also, when the filament 72 is sealingly inserted into the internal space of the outer pipe 71 together with a non-oxidative gas, particles or the like may not be generated. Therefore, the characteristics thereof may be further enhanced, and the filament 72 may be appropriately used at a temperature range of about 1200° C.

A rod 73 which extends to an external space of the outer pipe 71 may be fixed to both ends of the filament 72 in a lengthwise direction thereof. The rod 73 supports the filament 72 to be spaced apart from the outer pipe 71, and has a property of an electric conductor to transmit the electric energy to the filament 72.

An electro-conductive body 74 which connects the rod 73 with a power terminal for supplying the electric energy and transmits the electric energy supplied from the power terminal to the rod 73 may be installed at an end of the rod 73.

And the outer pipe 71 may be supported by an insulator 76. The insulator 76 serves to prevent the electric energy from leaking to an outside.

A fixing member 75 for fixing a blocking member 77 may be further provided at an outside of the insulator 76.

The fixing member 75 enables both ends of the blocking member 77 to be fixed to the outside of the insulator 76.

The fixing member 75 may be formed in a cylindrical shape having a predetermined thickness, and may be fitted and fixed to an outer surface of the insulator 76, and a position of the blocking member 77 may be fixed by the fixing member 75 while the blocking member 77 is located at the outside of the outer pipe 71.

That is, the blocking member 77 is in contact with the outside of the insulator 76, and the fixing member 75 covers a part of an outside of the blocking member 77, and thus the position of the blocking member 77 may be fixed.

The blocking member 77 prevents the filament 72 from absorbing the microwaves emitted from the magnetron 60.

Meanwhile, when the food accommodated in the internal space of the cooking chamber 40 is cooked using the microwaves emitted from the magnetron 60, the microwaves generates a large electric field at a gap between the filaments 72 formed by weaving the carbon fiber, and thus sparks may occur, or plasma may be induced into the internal space of the outer pipe 71.

The blocking member 77 may block the microwaves while being located to be spaced apart from an outer surface of the outer pipe 71 at a predetermined distance. Therefore, the blocking member 77 is also spaced apart from the filament 72. And the blocking member 77 may be disposed to face an opening 42 formed at the upper plate 41.

The blocking member 77 may be formed of a metallic wire, preferably a stainless metallic material. The blocking member 77 may be formed in a fiber weaving method to have a diameter of about 0.05 mm. That is, the blocking member 77 may be formed in a mesh shape.

Of course, the blocking member 77 may be formed in the fiber weaving method to have a diameter greater or less than 0.05 mm. However, as a result of a plurality of experiments, the stainless metallic material having the diameter of 0.05 mm may be the most preferable.

When the blocking member 77 is formed of the stainless metallic material having the diameter of 0.05 mm in the fiber weaving method, an opening ratio of about 70% or more may be maintained.

Also, when the blocking member 77 is located to be spaced apart from the outer surface of the outer pipe 71 at the predetermined distance, specifically at a distance of 0.1 to 15 mm, the radiant heat of the heater 70 may be most smoothly transferred to the internal space of the cooking chamber 40 while the blocking member 77 blocks the microwaves.

When the heater 70 is disposed at one side of the cooking chamber 40, the heater 70 is located to be exposed to the internal space of the cooking chamber 40, i.e., the space in which the food is cooked, and the heater 70 is protected from the microwaves by the blocking member 77 formed to cover the outer surface of the outer pipe 71, and also the sufficient opening ratio is provided, and thus the emission efficiency of the radiant heat emitted from the heater 70 may also be maximized.

Referring to FIG. 4, since the both ends of the blocking member 77 are located between the fixing member 75 and the insulator 76, the both ends of the blocking member 77 are tensioned, and thus the blocking member 77 may be installed to be spaced apart from the surface of the outer pipe 71.

Specifically, since the fixing member 75 formed in a circular pipe shape of which both ends are opened is fitted to the outer surface of the insulator 76, the blocking member 77 may be fixed to the outer surface of the insulator 76.

At this point, a hooking loop for hooking and fixing the blocking member 77 is formed at an inner surface of the fixing member 75, and the blocking member 77 may be hooked and coupled thereto, and thus may be prevented from being deviated between the fixing member 75 and the insulator 76.

As another example, an insertion groove in which the blocking member 77 may be inserted may be formed at the fixing member 75, and the blocking member 77 may be inserted and coupled into the insertion groove of the fixing member 75.

Figure 5:
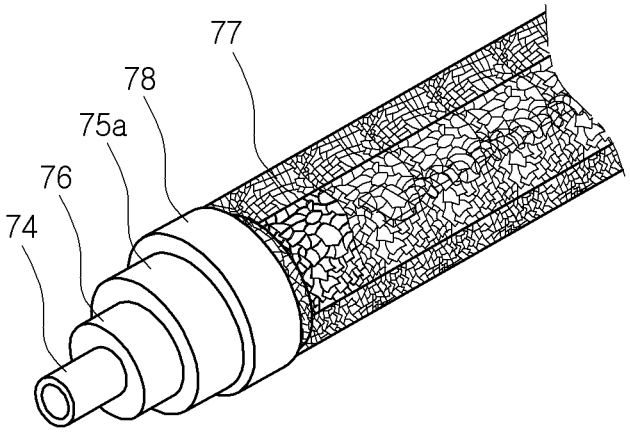
FIG. 5 is an enlarged perspective view illustrating a part of a heater of a cooking device according to another embodiment.
Figure 6:
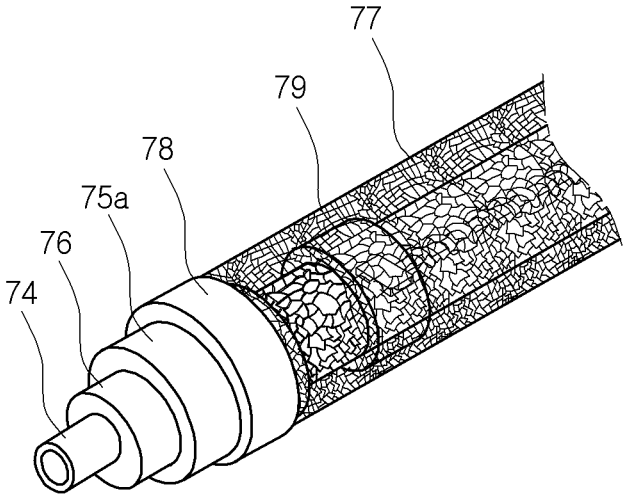
FIG. 6 is an enlarged perspective view illustrating a part of a heater of a cooking device according to still another embodiment.

FIG. 5 is an enlarged perspective view illustrating a part of a heater of a cooking device according to another embodiment, and FIG. 6 is an enlarged perspective view illustrating a part of a heater of a cooking device according to still another embodiment.

First, referring to FIG. 5, the position of the blocking member 77 may be fixed by a first fixing member 75*a* and a second fixing member 78.

Specifically, the first fixing member 75*a* may be coupled so as to cover the outside of the insulator 76. And the blocking member 77 may cover an outside of the first fixing member 75*a*. And the second fixing member 78 may cover the outside of the blocking member 77.

That is, a part of the blocking member 77 may be located between an outer surface of the first fixing member 75*a* and an inner surface of the second fixing member 78.

Then, referring to FIG. 6, a gap maintaining member 79 may be located between the outer surface of the outer pipe 71 and the blocking member 77 in a structure of FIG. 5. The gap maintaining member 79 may be installed so that the blocking member 77 and the outer surface of the outer pipe 71 may be spaced apart from each other at a predetermined distance. The gap maintaining member 79 covers a circumference of the outer pipe 71.

Specifically, even though the blocking member 77 is directed in a direction of the outer surface of the outer pipe 71 due to an unintended shock or because self-elasticity of the blocking member 77 is reduced, the blocking member 77 may be prevented by the gap maintaining member 79 from being in contact with the outer surface of the outer pipe 71.

The gap maintaining member 79 has a predetermined thickness and area, and is formed in a circular ring shape of which both ends are opened, and the blocking member 77 and the outer pipe 71 may be maintained to be spaced apart from each other by the thickness of the gap maintaining member 79.

However, when an area of the gap maintaining member 79 is increased, the calorific value radiated through the outer pipe 71 may be reduced. Therefore, the gap maintaining member 79 may preferably be formed to have an appropriate area, and may be formed of a material which endures the radiant heat radiated through the outer pipe 71.

Like this, while the position of the blocking member 77 may be fixed by the fixing members 75, 75*a* and 78, the blocking member 77 may be maintained to be spaced apart from the outer surface of the outer pipe 71 at a predetermined gap. Accordingly, the microwaves which are irregularly reflected inside the cooking chamber 40 may be blocked from leaking to an inside of the outer pipe 71.

As another example, a plurality of hooking loops may be formed at the insulator 76, and the blocking member 77 may be hooked to the plurality of hooking loops, and thus the position of the blocking member 77 may be fixed.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A cooking device comprising:

a cooking chamber configured to provide a space in which food is cooked;

a magnetron configured to emit microwaves to the cooking chamber; and a heater configured to emit radiant heat to the cooking chamber, wherein the heater comprises a filament, an outer pipe which protects the filament, and a blocking member which covers an outer surface of the outer pipe to block the microwaves emitted from the magnetron, wherein the heater further comprises an insulator which supports the outer pipe, and a fixing member which is coupled to the insulator and fixes a position of the blocking member, wherein the blocking member is in contact with an outer surface of the insulator, and the fixing member covers a part of an outer surface of the blocking member.

2. The cooking device of claim 1, wherein the blocking member is formed of a stainless material.

3. The cooking device of claim 1, wherein the blocking member is formed in a mesh shape so that heat and light from the filament passes therethrough.

4. The cooking device of claim 3, wherein an opening ratio of the blocking member is 70% or more.

5. The cooking device of claim 1, wherein the blocking member covers an outside of the outer pipe, and is spaced apart from the outer pipe.

6. The cooking device of claim 5, wherein the blocking member is formed in a tube shape.

7. The cooking device of claim 1, wherein the fixing member comprises a first fixing member which covers the insulator, and a second fixing member which is coupled to the first fixing member, and a part of the blocking member is located between the first fixing member and the second fixing member.

8. The cooking device of claim 1, wherein a part of the blocking member is located between the insulator and the fixing member.

9. The cooking device of claim 1, wherein the blocking member is fitted to the fixing member.

10. The cooking device of claim 1, further comprising an insulator which supports the outer pipe, wherein a plurality of hooking loops which hook and fix the blocking member are provided at the insulator.

11. The cooking device of claim 5, wherein a gap maintaining member which maintains a gap between the outer pipe and the blocking member is disposed between the outer pipe and the blocking member.

12. The cooking device of claim 11, wherein the gap maintaining member covers a circumference of the outer pipe.

* * * * *